US006929065B2

(12) United States Patent
Cannon

(10) Patent No.: US 6,929,065 B2
(45) Date of Patent: Aug. 16, 2005

(54) LATCH-TYPE TUBING PROTECTOR HAVING C-SHAPED CLAMPING MEMBERS, A MINIMIZED RUNNING PROFILE AND A LARGE HOLDING FORCE

(76) Inventor: James H. Cannon, P.O. Box 1306, Stafford, TX (US) 77497

( * ) Notice: Subject to any disclaimer, the term of this patent is extended or adjusted under 35 U.S.C. 154(b) by 10 days.

(21) Appl. No.: 10/638,281

(22) Filed: Aug. 8, 2003

(65) Prior Publication Data

US 2005/0028986 A1 Feb. 10, 2005

(51) Int. Cl.[7] ..... E21B 17/10
(52) U.S. Cl. ..... 166/241.7
(58) Field of Search ..... 166/241.7, 172; 175/325.6

(56) References Cited

U.S. PATENT DOCUMENTS 4,219,081 A * 8/1980 Howe ..... 166/241.7
4,531,582 A * 7/1985 Muse et al. ..... 166/241.7
4,601,334 A * 7/1986 Lovegrove ..... 166/241.7
4,603,737 A * 8/1986 Spikes ..... 166/241.7
4,651,823 A * 3/1987 Spikes ..... 166/241.7
4,909,322 A * 3/1990 Patterson et al. ..... 166/241.7

* cited by examiner

*Primary Examiner*—Hoang Dang
(74) *Attorney, Agent, or Firm*—Robert W Strozier

(57) ABSTRACT

Apparatus for protecting tool joints and injection or control tubing of production tubing strings employed in the production of oil and gas is disclosed, where the protector has a minimized running profile and includes two C-shaped clamping members designed to be forced onto a pipe string above and below a joint with sufficient holding force to allow protector assembly without the need to hold the ends in place during the assembly process. The protector also includes beveled leading and trailing edges to further minimize the likelihood that the protector will hang up during production string insertion and withdrawal.

38 Claims, 8 Drawing Sheets

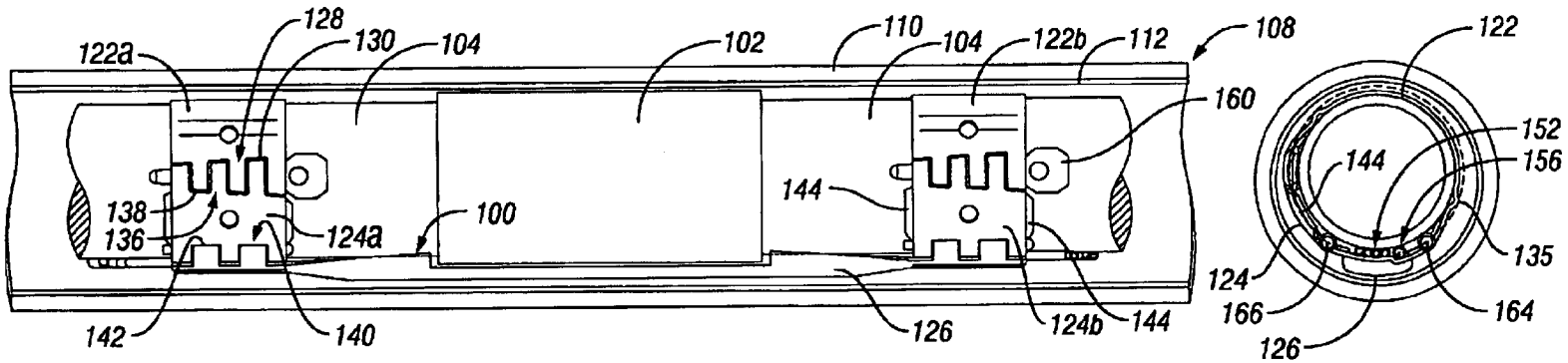
FIG. 1B
FIG. 1A
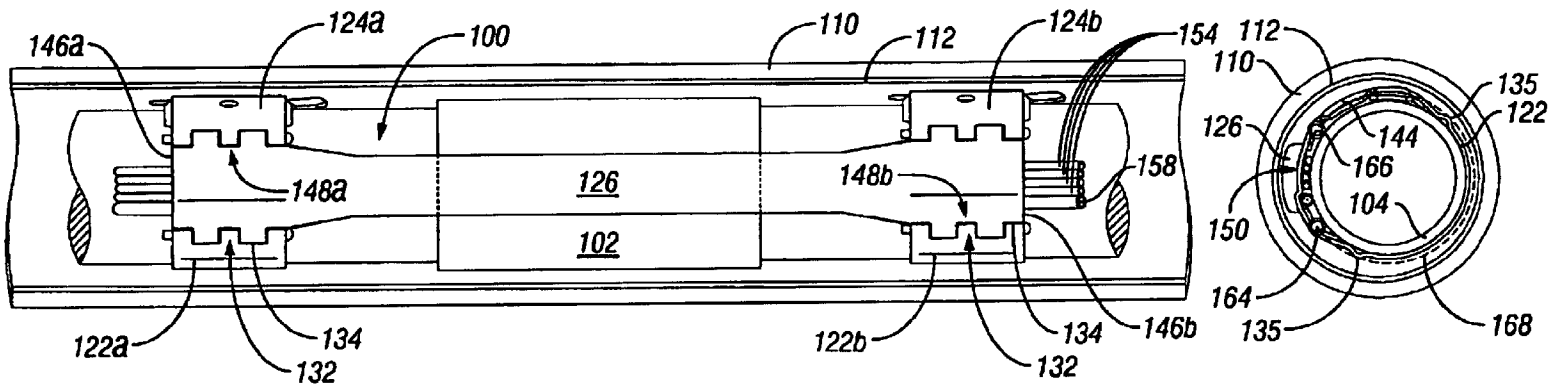
FIG. 1D
FIG. 1C

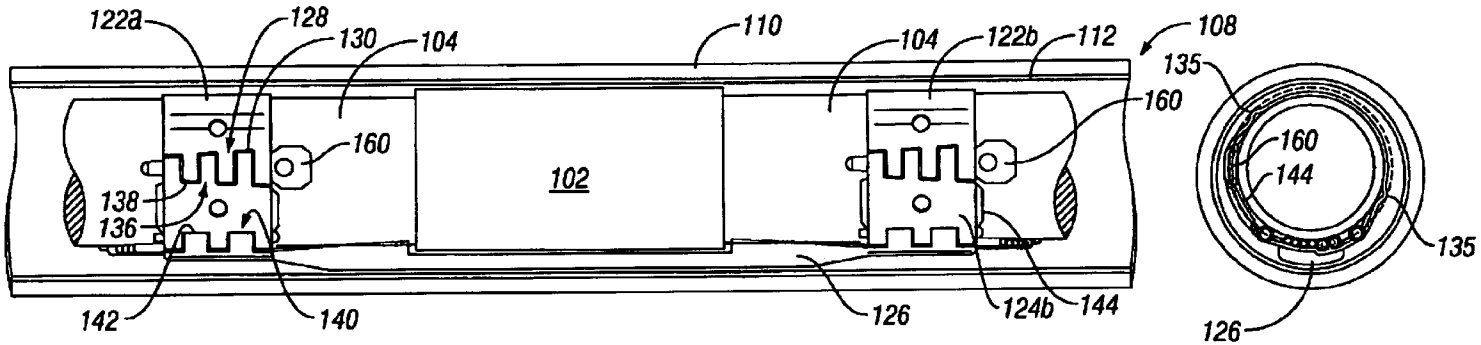
FIG. 1E
FIG. 1F
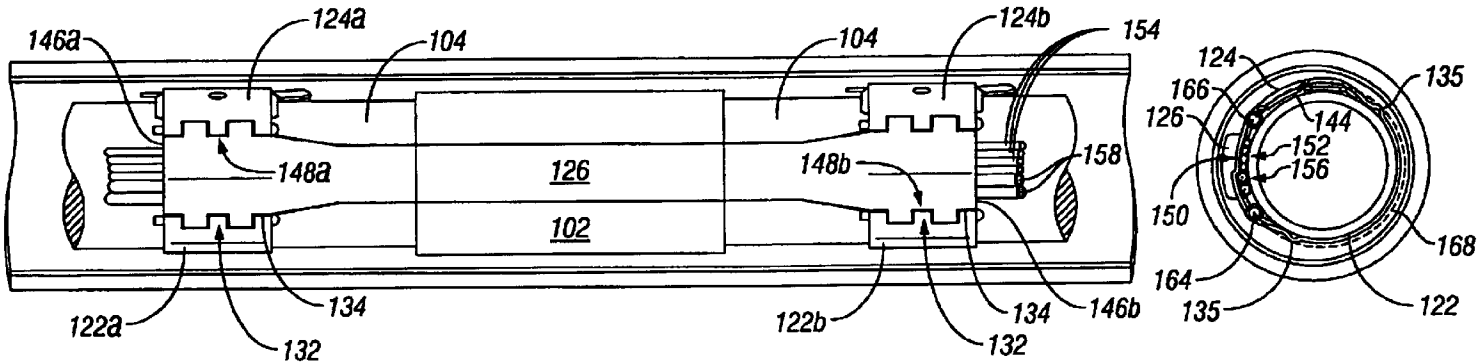
FIG. 1G
FIG. 1H

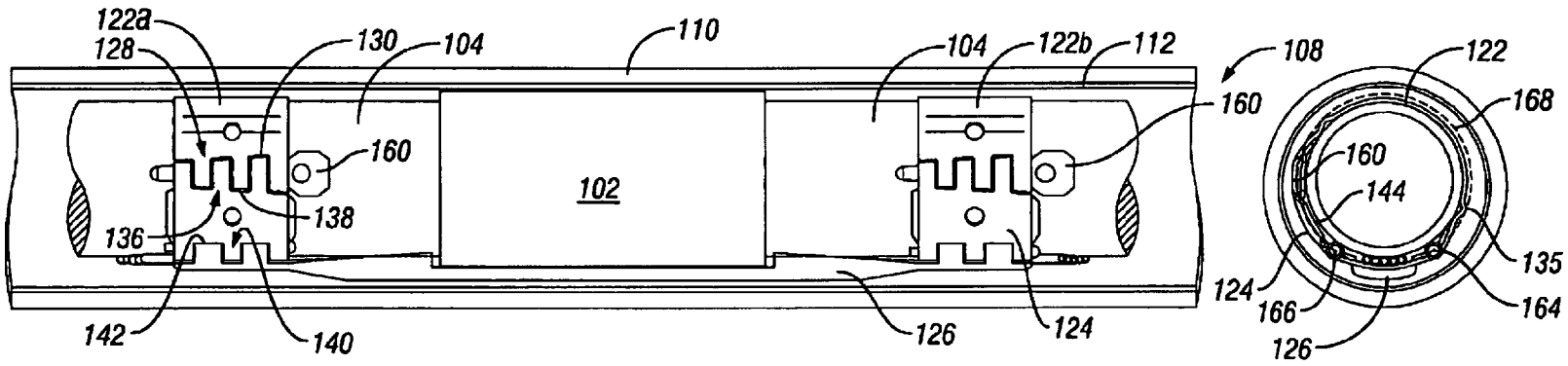
FIG. 1I
FIG. 1J
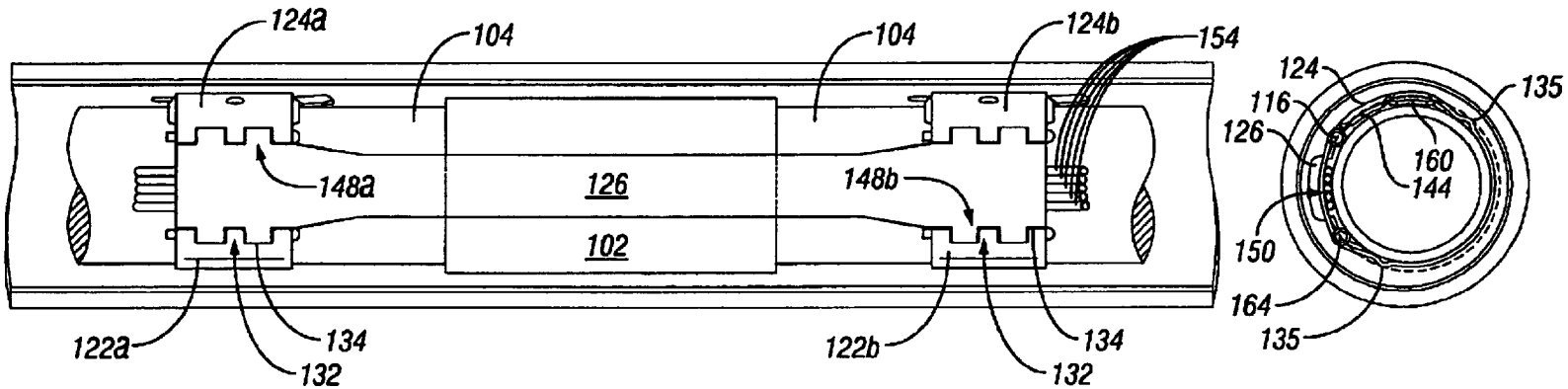
FIG. 1K
FIG. 1L

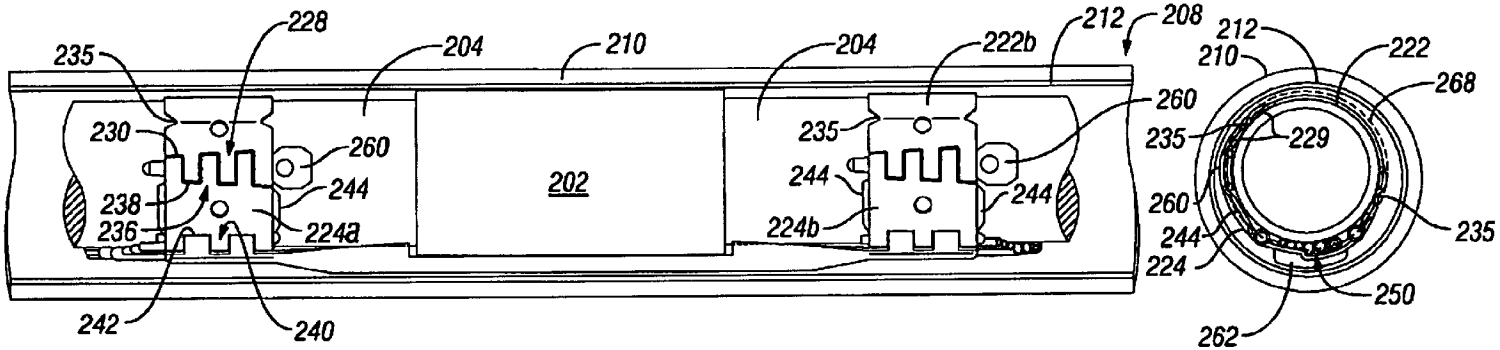
FIG. 2J
FIG. 2I
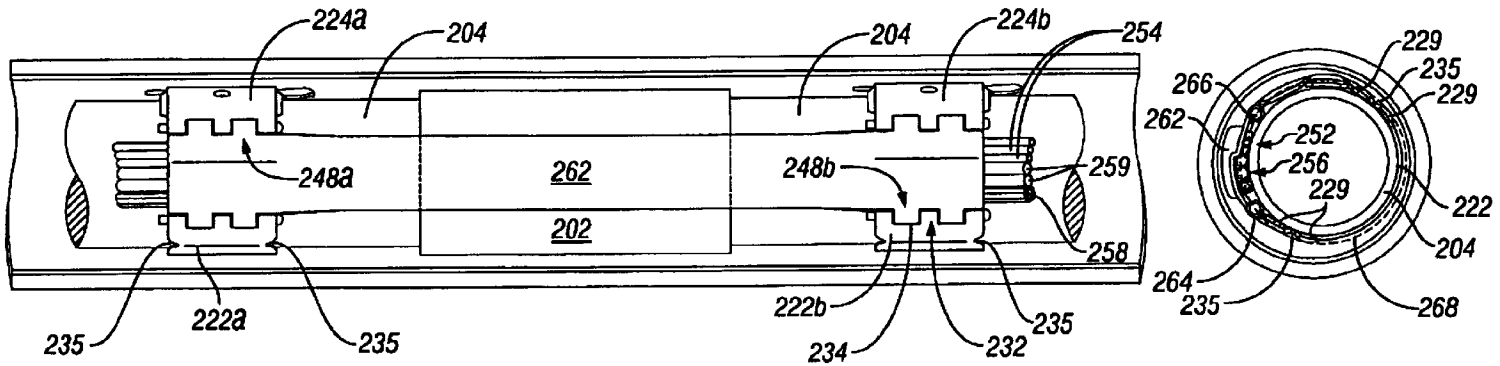
FIG. 2L
FIG. 2K

LATCH-TYPE TUBING PROTECTOR HAVING C-SHAPED CLAMPING MEMBERS, A MINIMIZED RUNNING PROFILE AND A LARGE HOLDING FORCE

BACKGROUND OF THE INVENTION

1. Field of the Invention

This invention relates to protectors for use in protecting tubular goods employed in the petroleum industry having a minimized running profile.

More particularly, this invention relates to a latch-type protectors adapted to protect encapsulated or bare auxiliary tubing at tool joints of tubing strings, to have a low profile or a minimized running profile to reduce hangup problems, and to provide an initial clamping force to hold the protector in place during installation.

2. Description of the Related Art

In the petroleum industry, production tubing is disposed within a borehole for transporting oil and gas from subsurface bearing formations to the surface. This tubing is comprised of elongate sections threaded together to form a production string, the joint thereby formed being referred to variously as a tool joint, coupling, or upset.

In conjunction with this production tubing, it is frequently necessary to provide a system for delivering fluid media downhole. One reason may be to permit the injection of chemical treatment fluids near the producing formation for enhancing the production, for treatment of downhole conditions such as those involving undesirable corrosion, salt, or scale, and for delivery of corrosion or scale inhibitors, de-emulsifiers, or the like, downhole.

Yet another reason for providing these fluid delivery systems is for the transmission of fluid pressure to various downhole valves or tools from the surface for purposes of control or the like. Thus, various forms of injection or control lines referred to hereinafter generally as tubing and having internal diameters much smaller than that of the production tubing itself are provided which are disposed radially outward of and adjacent to the production tubing. In some cases the tubing is of an encapsulated variety wherein both the tubing and wire rope (which provides crush resistance from side forces) are encapsulated in an appropriate thermoplastic elastomer, whereas in other applications, the tubing may be of an unencapsulated or bare variety.

In other situations, electrical cables are routed downhole in like manner to the tubing for monitoring pressure instruments or for providing power for downhole motors or the like.

One problem with these tool joints and the associated tubing or cables (referred to hereinafter as tubing for convenience) is that they are frequently subjected to damage from contact with surrounding casing or the formation itself, such as when the production string is moved up or down within the borehole. This damage may be due to abrasion or compressive forces against the joint or tubing which often occurs as the tool joint is moved across a deviation in the borehole. Thus, means were sought for protecting this bare or unencapsulated tubing, cable and the tool joints from damage.

With reference to the accompanying drawings in general, in its most common form this protection took the form of a hollow cylindrically-shaped metallic cover known generally as a tubing protector comprised of half-sections which were disposed circumferentially about the tool joint and the injection or control tubing. These half-sections were hinged longitudinally along diametrically opposed edges by means of two piano-type hinges with mating straight hinge pins. A representative such protector may be seen depicted generally at page 4612 of the 1982–83 Composite Catalog of Oilfield Equipment and Services, published by World Oil.

A plurality of radially inwardly-extending lugs were disposed on the inner surface of the protector at opposed ends which were sized whereby they could form an interference fit contacting the outer surface of the production tubing or sloping portions of the tool joint itself.

These interference fits were intended to prevent relative rotational and longitudinal movement between the protector on the one hand and the production and injection or control tubing. Both such motions were frequently the cause of serious damage to the tool joint and tubing, such as the crimping or crushing of the injection tubing, abrasion of the tool joints, etc.

Although such tubing protectors of various designs afforded some degree of protection, several problems became associated with these protectors. First, the outer diameters of couplings of the commercially available production tubing such as the diameter of the portion of some joints known as the "upset" vary as a function of the specified weight of the production tubing for a given nominal production tubing o.d., the larger sizes of production tubing having greater variations. For example, production tubing having a four inch outer diameter may have tool joints which vary in outer diameter by as much as one inch. However, such widely-ranging variances in outer diameters made the aforementioned critical interference fits difficult to achieve.

One approach to this problem was to fabricate half-sections of protectors of varying sizes. In this manner, half-sections may be paired in relation to the given outer diameter of the given tool joint so as to provide a custom fit. However, such an approach was found to be commerically impractical for several reasons. First, numerous dies of varying radii of curvature had to be maintained for each weight of tubing to provide the desired nominal inner diameters of the tubing protector half-sections to cover the widely varying ranges of outer diameters of the tool joints.

Due to the hinging on both sides of the protector, variation in internal diameters thereof to accommodate different tool joints was provided primarily from the different sizes of protector half-sections which were staked. This approach was found to be prohibitively expensive, resulting in high production costs, large inventory levels, and large amounts of capital tied up in stock in order to accommodate the varying sizes.

Moreover, even for a given specified nominal size of production tubing, manufacturing tolerances, wear on the joints during use, or the like still resulted in oversizing or undersizing of tool joint outer diameters by as much as 0.020–0.030 inches from the specified value. Also the outer diameter of the tubing itself in accordance with conventional industry standard could often typically vary by as much as .+–0.0.031 inches or .+–0.0.75% for tubing up to 4 inches in diameter or for tubing of 4 inches or more in diameter, respectively. This factor made it not only desirable but often essential to be able to custom fit such protectors at the wellsite to achieve the necessary close interference fit.

Furthermore, the outer diameter of the radially outward sloping portion of tool joints also varied with a given weight of production tubing. Thus for a given such weight, it was not uncommon to see in the field substantial variances in length of these portions of the tool joints. This in turn made it difficult to provide for reliable interference fits between these portions and the aforementioned lugs, which is why it was typical in the industry to provide for as much as 0.060–0.080 design clearance between the aforementioned lugs and the production tubing.

This, in turn, meant that it was anticipated that the tubing protector would slide longitudinally along the production tubing until such an interference fit contact between the lugs and the tool joint was effected. Whereas a slight amount of longitudinal displacement of the tubing protector relative to the production tubing was permissible without causing undue wear on the tool joint or tubing, such clearance would at times permit relative rotational movement between the tool joint and the protector. As previously discussed, this frequently resulted in damage to the injection or control tubing and undue wear on the tool joint.

Yet another serious problem encountered in prior tubing protectors was associated with the provision of diametrically opposed piano-type hinges as previously described. In order to effect the necessary tight interference fit, the pins were subjected to inordinately high strains. This was particularly due to the aforementioned impracticability of providing custom fits by means of appropriately sized half-sections alone. Thus installers of the protectors would attempt to make do with the size protector they had on hand, often employing installation or compression tools for compressing the ill-fitting protector sections about the production tubing. This, in turn, frequently resulted in permanent deformation of protector half-sections and hinge pins, thus rendering their removal difficult and their re-installation ill-advised at best and oftentimes impossible.

In summary, tubing protectors were required to fit wide ranges of tubing o.d.s from ¾ inch to 4½ inches for example. Even for a specified o.d., it might vary by the aforementioned 0.031 inches or 0.75% or more depending upon where, manufacturer tolerance, and the like. Moreover, for a given tubing o.d., the associated commercially available specified tool joint nominal o.d. also could vary by as much as one inch or more.

Still further, as previously noted, this joint o.d. itself could vary typically by 0.020–0.030 inches due to tolerances, wear, and the like. All of these variations required manufacturers to provide at times as many as 30 different sizes or radius of curvature half-sections of protectors.

Accordingly, due to all of these ranges and dimensional variances, a latch-type production tubing protector was desired which was easy and inexpensive to manufacture, install, and remove, avoided the need for large numbers of dies, inventories of different parts and the like, and yet reliably accommodated a wide variation of tubing and tool joint sizes.

U.S. Pat. No. 4,615,543 disclosed a latch type protector which solved many of this problems. However, problems with this type of protector were also experienced. First, the protector took at least two people to install, one to hold the pieces in place bridging a joint and the other to closed and set the protector. Moreover, the protectors have an insufficient holding for force to resist movement when production tubing is run into well with substantial deviations.

Thus, there is a need in the art for an improved latch type protector which can be installed by a single person and has a sufficient holding force to resist movement in response to forces in excess of 4000 psi.

SUMMARY OF THE INVENTION

The present invention provides a latch-type joint protector including: an elongate tubing protective member having first and second ends, each end including right and left hinge connectors; a pair of bridging members having first and second ends, one end including a hinge connector and the other end including a latching connector; a pair of C-shaped clamping member having first and second ends, one end including a hinge connector and the other end including a latching connector; a pair of hinge pins adapted to insert into mated pairs of hinge connectors to form hinge connections; and a pair of latch keys adapted to insert into mated pairs of latch connectors to form latch connections, where the C-shaped clamping members are designed to be forced over a pipe one above a joint, one below the joint, and having a sufficient clamping force to hold in place up to about 1000 lbs/in$^2$ of applied external force and where the protector has a minimized running profile.

The present invention also provides a latch-type joint protector including: an elongate tubing protective member having first and second ends, each end including right and left hinge connectors; a pair of bridging members having first and second ends, one end including a hinge connector and the other end including a latching connector; a pair of C-shaped clamping member having first and second ends, one end including a hinge connector and the other end including a latching connector and lengthwise extending stress relief/conformance grooves or protrusions; a pair of hinge pins adapted to insert into mated pairs of hinge connectors to form hinge connections; and a pair of latch keys adapted to insert into mated pairs of latch connectors to form latch connections, where the C-shaped clamping members are designed to be forced over a pipe one above a joint, one below the joint, and having a sufficient clamping force to hold in place up to about 1000 lbs/in$^2$ of applied external force and where the protector has a minimized running profile.

The present invention provides a method for mounting the protectors of this invention including the steps of positioning a first C-shape clamping member above a joint of the drill string, forcing the member onto the pipe, where the first member engages the pipe with sufficient clamping force to remain in place during normal protector mounting, positioning a second C-shape clamping member below a joint of the drill string, and forcing the member onto the pipe, where the second member engages the pipe with sufficient clamping force to remain in place during normal protector mounting. Once the two C-shaped clamping members have been forced in place, control tubing or cable is fitted into an interior groove of an elongate tubing protecting member. With the control tubing or cable fitted into the interior groove of the elongate tubing protecting member, hinge connectors of the elongate tubing protector are mated with corresponding hinge connectors on the C-shaped clamping members and hinge pins are inserted into the mated hinge connectors to form hinge connections. Next, hinge connectors of bridging members are mated with corresponding hinge connectors on the elongate tubing protecting member and hinge pins are inserted into the mated hinge connectors to form hinge connections. Finally, latch connectors on the bridging members are mated to latch connectors on the C-shaped clamping members and tapered latch keys are inserted into the mated latch connectors with sufficient force so that the protector will remain in place when subjected to a shear force not exceeding about 3500 psi, preferably not exceeding about 5500 psi, particularly not exceeding about 7500 psi, and especially not exceeding 9000 psi.

DESCRIPTION OF THE DRAWINGS

The invention can be better understood with reference to the following detailed description together with the appended illustrative drawings in which like elements are numbered the same:

FIG. 1A–D are four views depicting one embodiment of a latch-type tubing protector of the present invention attached over a pipe joint of a pipe string inside a cased well; (outies—bridging unit bevels)

FIG. 1E–H are four views depicting one embodiment of a latch-type tubing protector of the present invention attached over a pipe joint of a pipe string inside a cased well; (outies—bridging unit bevels—interior bumps)

FIG. 1I–L are four views depicting one embodiment of a latch-type tubing protector of the present invention attached over a pipe joint of a pipe string inside a cased well; (outie, innie—bridging unit bevels—interior bumps partial pattern)

FIG. 2I–L are four views depicting one embodiment of a latch-type tubing protector of the present invention attached over a pipe joint of a pipe string inside a cased well; (innies—full bevels—interior circumferential ridges)

DETAILED DESCRIPTION OF THE INVENTION

Figure 2B:
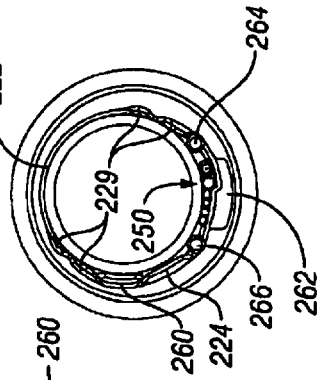
FIG. 2A–D are four views depicting another embodiment of a latch-type tubing protector of the present invention attached over a pipe joint of a pipe string inside a cased well.
Figure 2A:
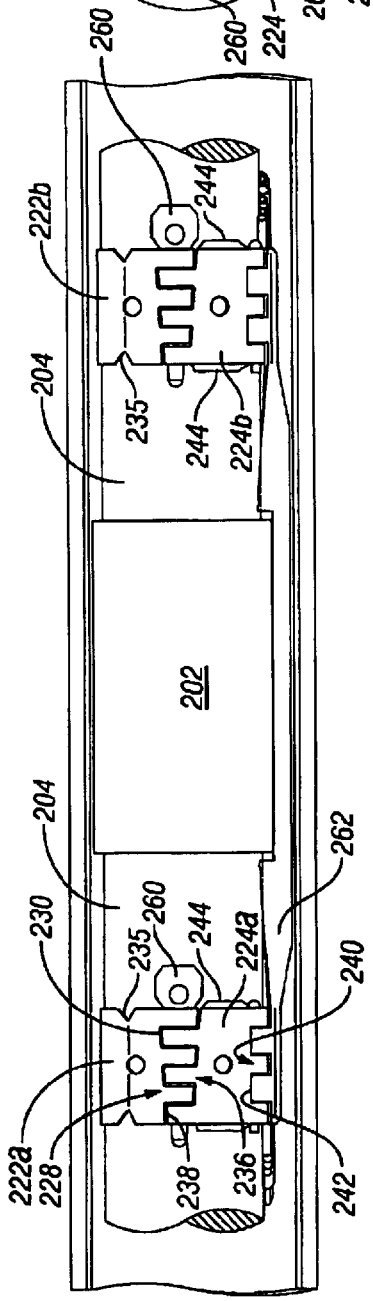
Figure 2D:
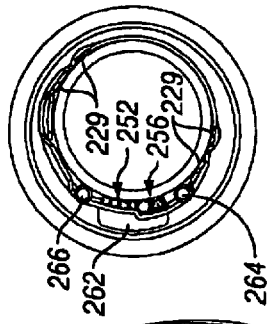
Figure 2C:
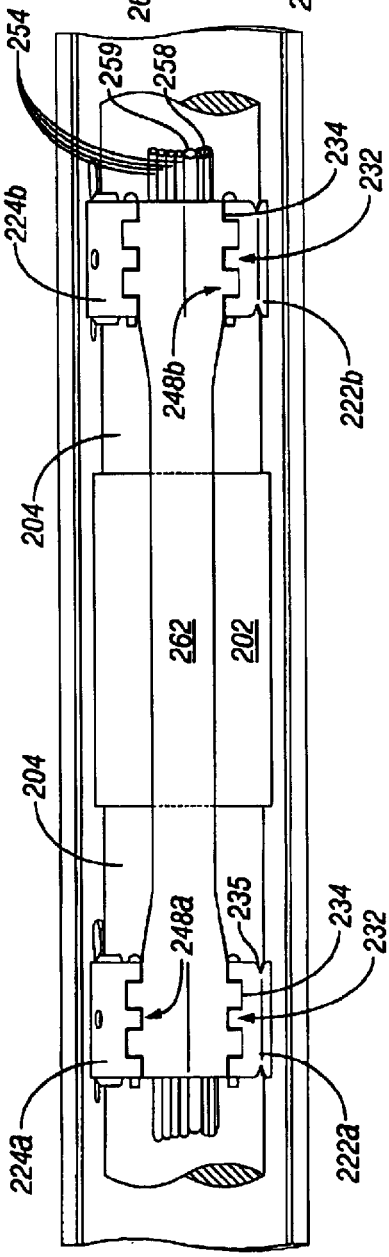
Figure 2F:
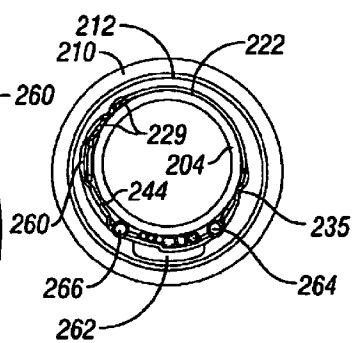
FIG. 2E–H are four views depicting one embodiment of a latch-type tubing protector of the present invention attached over a pipe joint of a pipe string inside a cased well; (innies—full bevels)
Figure 2E:
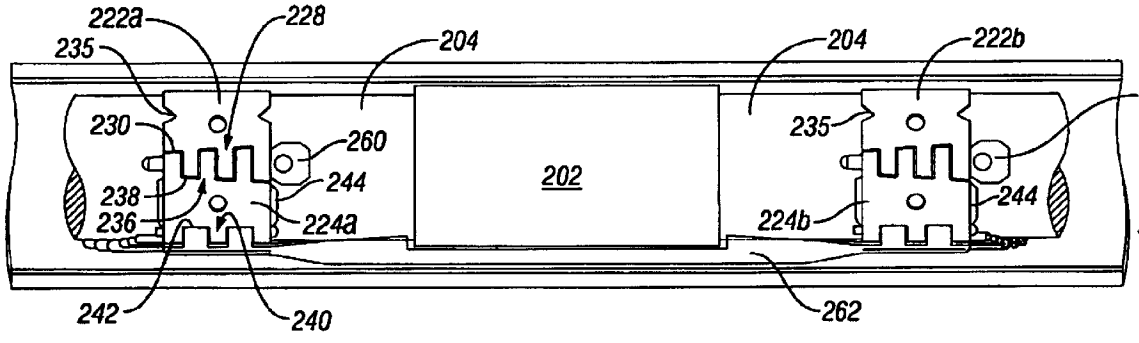
Figure 2H:
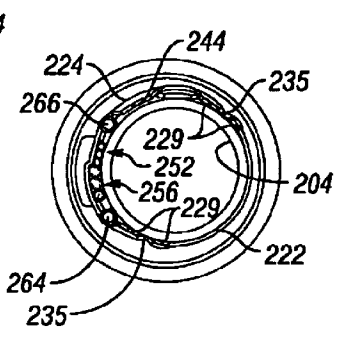
Figure 2G:
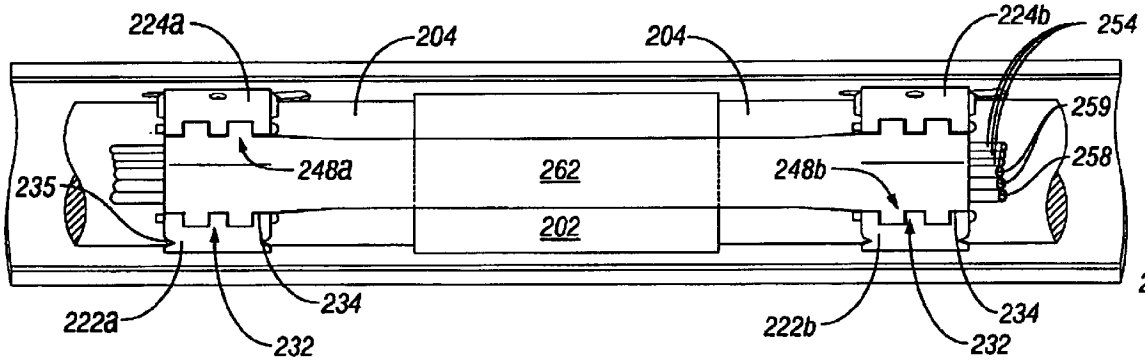
Figure 2N:
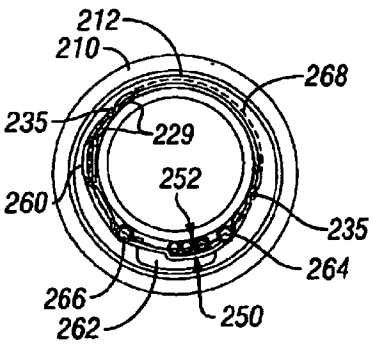
FIG. 2M–P are four views depicting one embodiment of a latch-type tubing protector of the present invention attached over a pipe joint of a pipe string inside a cased well; (innies—full bevels—interior spikes)
Figure 2M:
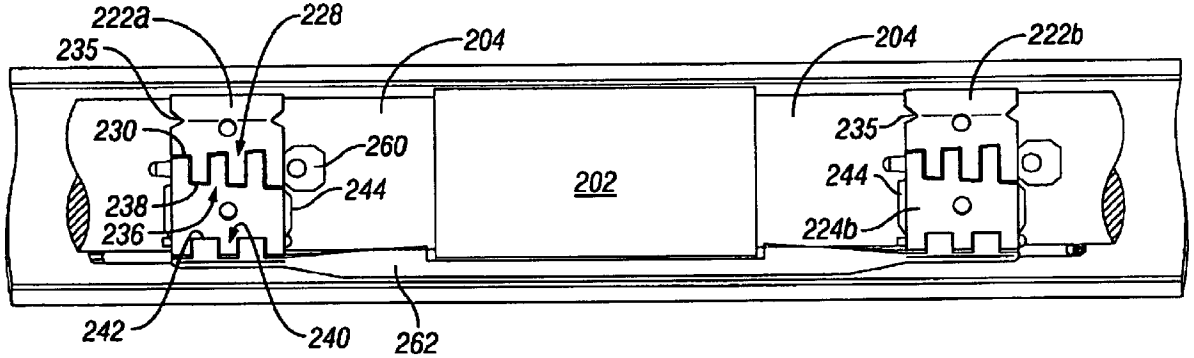
Figure 2P:
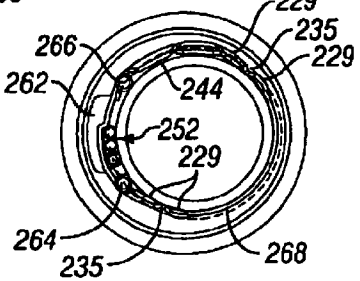
Figure 2O:
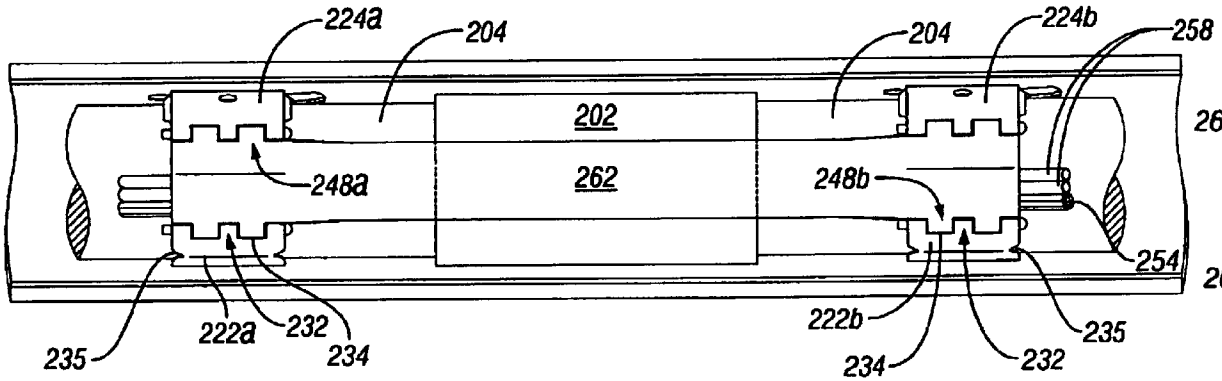

The inventors have found that a pipe joint protector can be constructed including channel member, two C-shaped members and two bridging members, where the C-shaped members are adapted to be forced over a drill pipe above and below a pipe joint and form fit with sufficient force to hold the protector in place during protector assembly. The inventor has found that having the C-shaped members, the protectors can be installed by a single person without being concerned with the protector falling off the pipe of sliding down the pipe during assembly.

The present inventor broadly relates to an improved pipe joint protector that forms a protected channel over the pipe joint through which lines can be run, where the protector includes an elongate tubing protective member have an elongate a bluff-shaped contour, a first end and a second end. Each end including two lateral hinge connectors. One pair of lateral hinge connectors are adapted to matingly engage hinge connectors associated with first ends of a pair of bridging members and receive hinge pins to form hinge connections. The other pair of lateral hinge connectors are adapted to matingly engage hinge connectors associated with first ends of a pair of C-shaped clamping members. The C-shaped clamping members and the bridging members also include latch connectors adapted to receive a tapered key when the latching connectors are matingly engaged. The C-shaped clamping members also include vertical extending stress relief indentations and/or protrusions located near the connectors. The C-shaped clamping members are designed to be forced over a pipe above and below a pipe joint and lockingly engage the pipe sufficient with a sufficient holding force to allow protector construction without the need to hold the components of the protector in place while the protector is being assembled. The present invention also broadly relates to a method for installing the protectors on a drill string. The protector is designed to have a minimized running profile.

Referring now to FIG. 1A–D, one preferred embodiment of a protector of this invention, generally 100, is shown attached across a joint 102 connecting two pipes 104 of a pipe string 106 within a cased well 108 including a casing 110 and a casing sleeve 112. The protector 100 includes a pair of C-shaped clamping members 122*a–b*, a corresponding pair of bridging members 124*a–b* and an elongate tubing protective member 126 connected to and extending between the two C-shaped clamping member-bridging member pairs 122*a*+124*a* and 122*b*+124*b*.

Each C-shaped member 122*a–b* includes a taper latch key connector 128 at a first end 130 and a hinge connector 132 at a second end 134. Each C-shaped clamping member 122*a–b* is designed to be forced onto the pipes 104, one below and one above the joint 102. The C-shaped clamping members 122*a–b* have an arcuate shape and are designed to tightly engage the surface of the pipes 104 with sufficient holding force so that the remainder of the protector 100 can be assembled without requiring a person to hold the ends of the protector in place while the remainder of the protector is assembled. Each C-shaped clamping member 122*a–b* also includes stress relieving longitudinally extending protrusions 135.

Each bridging member 124*a–b* includes a taper latch key connector 136 at a first end 138 and a hinge connector 140 at a second end 142. Each bridging member 124*a–b* also includes a beveled leading and trailing ends 144. The elongate member 126 includes first and second ends 146*a–b*, each end 146*a–b* includes right and left lateral hinge connectors 148*a–b* and an interior channel 150 including a first area 152 for receiving up to four bare tubes 154 and a second larger area 156 for receiving a insulated tube 158.

The tapered latch key connectors 128 on the C-shaped members 122*a–b* and the tapered latch key connectors 136 are designed to engaged each other and to receive tapered keys 160. The key 160 includes a beveled top 162. The hinge connectors 132 on the C-shaped members 122*a–b* and the left hinge connectors 148*b* on the elongate member 126 are designed to engage each other and to receive hinge pins 164. While the right hinge connectors 148*a* on the elongate member 126 and the hinge connectors 140 on the bridging members 124*a–b* are designed to engage each other and to receive hinges pin 166.

The protector 100 is designed to be assembled by first forcing the clamping member 122*a–b* over the pipes 104 above and below the joint 102, where the member 122*a–b* hold the pipe with sufficient holding force to allow one person to install the protector 100 without concern of the clamping members 122*a–b* sliding down the pipes 104. Next, the hinge connectors 148*a–b* on the protecting member 126, the hinge connectors 132 on the clamping member 122*a–b* and the hinge connectors 140 on the bridging members 124*a–b* are mated and the hinge pins 164 and 166 are inserted into the mated connectors to form hinge connections. Finally, the latch connectors 128 and 136 are mated and the latch keys 160 are inserted. Once fully made up, the protectors 100 are designed to engage the pipes 104 with sufficient holding force to resist movement upon application of an external force not exceeding about 3000 psi, preferably, not exceeding about 4000 psi, particularly, not exceeding about 6000 psi, more particularly, not exceeding about 8000 psi, most particularly, not exceeding about 9000 psi and especially, particularly, not exceeding about 10000 psi. The protector 100 is also designed to have a smaller running profile than traditional latch type protectors as shown in the dashed line 168.

Referring now to FIG. 1E–H, one preferred embodiment of a protector of this invention, generally 100, is shown attached across a joint 102 connecting two pipes 104 of a pipe string 106 within a cased well 108 including a casing 110 and a casing sleeve 112. The protector 100 includes a pair of C-shaped clamping members 122*a–b*, a corresponding pair of bridging members 124*a–b* and an elongate tubing protective member 126 connected to and extending between the two C-shaped clamping member-bridging member pairs 122*a*+124*a* and 122*b*+124*b*.

Each C-shaped member 122*a–b* includes a taper latch key connector 128 at a first end 130 and a hinge connector 132 at a second end 134. Each C-shaped clamping member 122*a–b* is designed to be forced onto the pipes 104, one below and one above the joint 102. The C-shaped clamping members 122*a–b* have an arcuate shape and are designed to tightly engage the surface of the pipes 104 with sufficient holding force so that the remainder of the protector 100 can be assembled without requiring a person to hold the ends of the protector in place while the remainder of the protector is assembled. Each C-shaped clamping member 122*a–b* also includes stress relieving longitudinally extending protrusions 135.

Each bridging member 124*a–b* includes a taper latch key connector 136 at a first end 138 and a hinge connector 140 at a second end 142. Each bridging member 124*a–b* also includes a beveled leading and trailing ends 144. The elongate member 126 includes first and second ends 146*a–b*, each end 146*a–b* includes right and left lateral hinge connectors 148*a–b* and an interior channel 150 including a first area 152 for receiving up to four bare tubes 154 and a second larger area 156 for receiving two insulated tubes 158.

The tapered latch key connectors 128 on the C-shaped members 122*a–b* and the tapered latch key connectors 136 are designed to engaged each other and to receive tapered keys 160. The key 160 includes a beveled top 162. The hinge connectors 132 on the C-shaped members 122*a–b* and the left hinge connectors 148*b* on the elongate member 126 are designed to engage each other and to receive hinge pins 164. While the right hinge connectors 148*a* on the elongate member 126 and the hinge connectors 140 on the bridging members 124*a–b* are designed to engage each other and to receive hinges pin 166.

The protector 100 is designed to be assembled by first forcing the clamping member 122*a–b* over the pipes 104 above and below the joint 102, where the member 122*a–b* hold the pipe with sufficient holding force to allow one person to install the protector 100 without concern of the clamping members 122*a–b* sliding down the pipes 104. Next, the hinge connectors 148*a–b* on the protecting member 126, the hinge connectors 132 on the clamping member 122*a–b* and the hinge connectors 140 on the bridging members 124*a–b* are mated and the hinge pins 164 and 166 are inserted into the mated connectors to form hinge connections. Finally, the latch connectors 128 and 136 are mated and the latch keys 160 are inserted. Once fully made up, the protectors 100 are designed to engage the pipes 104 with sufficient holding force to resist movement upon application of an external force not exceeding about 3000 psi, preferably, not exceeding about 4000 psi, particularly, not exceeding about 6000 psi, more particularly, not exceeding about 8000 psi, most particularly, not exceeding about 9000 psi and especially, particularly, not exceeding about 10000 psi. The protector 100 is also designed to have a smaller running profile than traditional latch type protectors as shown in the dashed line 168.

Referring now to FIG. 1I–L, one preferred embodiment of a protector of this invention, generally 100, is shown attached across a joint 102 connecting two pipes 104 of a pipe string 106 within a cased well 108 including a casing 110 and a casing sleeve 112. The protector 100 includes a pair of C-shaped clamping members 122*a–b*, a corresponding pair of bridging members 124*a–b* and an elongate tubing protective member 126 connected to and extending between the two C-shaped clamping member-bridging member pairs 122*a*+124*a* and 122*b*+124*b*.

Each C-shaped member 122*a–b* includes a taper latch key connector 128 at a first end 130 and a hinge connector 132 at a second end 134. Each C-shaped clamping member 122*a–b* is designed to be forced onto the pipes 104, one below and one above the joint 102. The C-shaped clamping members 122*a–b* have an arcuate shape and are designed to tightly engage the surface of the pipes 104 with sufficient holding force so that the remainder of the protector 100 can be assembled without requiring a person to hold the ends of the protector in place while the remainder of the protector is assembled. Each C-shaped clamping member 122*a–b* also includes stress relieving longitudinally extending protrusions 135.

Each bridging member 124*a–b* includes a taper latch key connector 136 at a first end 138 and a hinge connector 140 at a second end 142. Each bridging member 124*a–b* also includes a beveled leading and trailing ends 144. The elongate member 126 includes first and second ends 146*a–b*, each end 146*a–b* includes right and left lateral hinge connectors 148*a–b* and an interior channel 150 including a single area 152 for receiving up to five bare tubes 154.

The tapered latch key connectors 128 on the C-shaped members 122*a–b* and the tapered latch key connectors 136 are designed to engaged each other and to receive tapered keys 160. The key 160 includes a beveled top 162. The hinge connectors 132 on the C-shaped members 122*a–b* and the left hinge connectors 148*b* on the elongate member 126 are designed to engage each other and to receive hinge pins 164. While the right hinge connectors 148*a* on the elongate member 126 and the hinge connectors 140 on the bridging members 124*a–b* are designed to engage each other and to receive hinges pin 166.

The protector 100 is designed to be assembled by first forcing the clamping member 122*a–b* over the pipes 104 above and below the joint 102, where the member 122*a–b* hold the pipe with sufficient holding force to allow one person to install the protector 100 without concern of the clamping members 122*a–b* sliding down the pipes 104. Next, the hinge connectors 148*a–b* on the protecting member 126, the hinge connectors 132 on the clamping member 122*a–b* and the hinge connectors 140 on the bridging members 124*a–b* are mated and the hinge pins 164 and 166 are inserted into the mated connectors to form hinge connections. Finally, the latch connectors 128 and 136 are mated and the latch keys 160 are inserted. Once fully made up, the protectors 100 are designed to engage the pipes 104 with sufficient holding force to resist movement upon application of an external force not exceeding about 3000 psi, preferably, not exceeding about 4000 psi, particularly, not exceeding about 6000 psi, more particularly, not exceeding about 8000 psi, most particularly, not exceeding about 9000 psi and especially, particularly, not exceeding about 10000 psi. The protector 100 is also designed to have a smaller running profile than traditional latch type protectors as shown in the dashed line 168.

Referring now to FIG. 2A–D, one preferred embodiment of a protector of this invention, generally 200, is shown attached across a joint 202 connecting two pipes 204 of a pipe string 206 within a cased well 208 including a casing 210 and a casing sleeve 212. The protector 200 includes a pair of C-shaped clamping members 222*a–b*, a corresponding pair of bridging members 224*a–b* and an elongate tubing protective member 226 connected to and extending between the two C-shaped clamping member-bridging member pairs 222*a*+224*a* and 222*b*+224*b*.

Each C-shaped member 222*a–b* includes a taper latch key connector 228 at a first end 230, a hinge connector 232 at a second end 234 and stress relieving longitudinally extending indentations 235, one indentation 235 located near the key connector 228 and the other indentation 235 located near the hinge connector 232. The C-shaped members 222*a–b* also include beveled shoulders 229 located on each side of the indentations 235, where the beveled shoulders 229 are designed to minimize protector hangup during downhole operations. Each C-shaped clamping member 222*a–b* is designed to be forced onto the pipes 204, one below and one above the joint 202. The C-shaped clamping members 222*a–b* have an arcuate shape and are designed to tightly engage the surface of the pipes 204 with sufficient holding force so that the remainder of the protector 200 can be assembled without requiring a person to hold the ends of the protector in place while the remainder of the protector is assembled.

Each bridging member 224*a–b* includes a taper latch key connector 236 at a first end 238 and a hinge connector 240 at a second end 242. Each bridging member 224*a–b* also includes a beveled leading and trailing ends 244. The elongate member 226 includes first and second ends 246*a–b*, each end 246*a–b* includes right and left lateral hinge connectors 248*a–b* and an interior channel 250 including a first area 252 for receiving up to four bare tubes 254 and a second larger area 256 for receiving a square insulated tube 258 and a larger bare tube 259.

The tapered latch key connectors 228 on the C-shaped members 222*a–b* and the tapered latch key connectors 236 are designed to engaged each other and to receive tapered keys 260. The key 260 includes a beveled top 262. The hinge connectors 232 on the C-shaped members 222*a–b* and the left hinge connectors 248*b* on the elongate member 226 are designed to engage each other and to receive hinge pins 264. While the right hinge connectors 248*a* on the elongate member 226 and the hinge connectors 240 on the bridging members 224*a–b* are designed to engage each other and to receive hinges pin 266.

The protector 200 is designed to be assembled by first forcing the clamping member 222*a–b* over the pipes 204 above and below the joint 202, where the member 222*a–b* hold the pipe with sufficient holding force to allow one person to install the protector 200 without concern of the clamping members 222*a–b* sliding down the pipes 204. Next, the hinge connectors 248*a–b* on the protecting member 226, the hinge connectors 232 on the clamping member 222*a–b* and the hinge connectors 240 on the bridging members 224*a–b* are mated and the hinge pins 264 and 266 are inserted into the mated connectors to form hinge connections. Finally, the latch connectors 228 and 236 are mated and the latch keys 260 are inserted. Once fully made up, the protectors 200 are designed to engage the pipes 204 with sufficient holding force to resist movement upon application of an external force not exceeding about 3000 psi, preferably, not exceeding about 4000 psi, particularly, not exceeding about 6000 psi, more particularly, not exceeding about 8000 psi, most particularly, not exceeding about 9000 psi and especially, particularly, not exceeding about 10000 psi. The protector 200 is also designed to have a smaller running profile than traditional latch type protectors as shown in the dashed line 268.

Referring now to FIG. 2E–H, one preferred embodiment of a protector of this invention, generally 200, is shown attached across a joint 202 connecting two pipes 204 of a pipe string 206 within a cased well 208 including a casing 210 and a casing sleeve 212. The protector 200 includes a pair of C-shaped clamping members 222*a–b*, a corresponding pair of bridging members 224*a–b* and an elongate tubing protective member 226 connected to and extending between the two C-shaped clamping member-bridging member pairs 222*a*+224*a* and 222*b*+224*b*.

Each C-shaped member 222*a–b* includes a taper latch key connector 228 at a first end 230, a hinge connector 232 at a second end 234 and stress relieving longitudinally extending indentations 235, one indentation 235 located near the key connector 228 and the other indentation 235 located near the hinge connector 232. The C-shaped members 222*a–b* also include beveled shoulders 229 located on each side of the indentations 235, where the beveled shoulders 229 are designed to minimize protector hangup during downhole operations. Each C-shaped clamping member 222*a–b* is designed to be forced onto the pipes 204, one below and one above the joint 202. The C-shaped clamping members 222*a–b* have an arcuate shape and are designed to tightly engage the surface of the pipes 204 with sufficient holding force so that the remainder of the protector 200 can be assembled without requiring a person to hold the ends of the protector in place while the remainder of the protector is assembled.

Each bridging member 224*a–b* includes a taper latch key connector 236 at a first end 238 and a hinge connector 240 at a second end 242. Each bridging member 224*a–b* also includes a beveled leading and trailing ends 244. The elongate member 226 includes first and second ends 246*a–b*, each end 246*a–b* includes right and left lateral hinge connectors 248*a–b* and an interior channel 250 including a first area 252 for receiving up to three small bare tubes 254 and a second larger area 256 for receiving an insulated tube 258 and up to two larger bare tubes 259.

The tapered latch key connectors 228 on the C-shaped members 222*a–b* and the tapered latch key connectors 236 are designed to engaged each other and to receive tapered keys 260. The key 260 includes a beveled top 262. The hinge connectors 232 on the C-shaped members 222*a–b* and the left hinge connectors 248*b* on the elongate member 226 are designed to engage each other and to receive hinge pins 264. While the right hinge connectors 248*a* on the elongate member 226 and the hinge connectors 240 on the bridging members 224*a–b* are designed to engage each other and to receive hinges pin 266.

The protector 200 is designed to be assembled by first forcing the clamping member 222*a–b* over the pipes 204 above and below the joint 202, where the member 222*a–b* hold the pipe with sufficient holding force to allow one person to install the protector 200 without concern of the clamping members 222*a–b* sliding down the pipes 204. Next, the hinge connectors 248*a–b* on the protecting member 226, the hinge connectors 232 on the clamping member 222*a–b* and the hinge connectors 240 on the bridging members 224*a–b* are mated and the hinge pins 264 and 266 are inserted into the mated connectors to form hinge connections. Finally, the latch connectors 228 and 236 are mated and the latch keys 260 are inserted. Once fully made up, the protectors 200 are designed to engage the pipes 204 with sufficient holding force to resist movement upon application of an external force not exceeding about 3000 psi, preferably, not exceeding about 4000 psi, particularly, not exceeding about 6000 psi, more particularly, not exceeding about 8000 psi, most particularly, not exceeding about 9000 psi and especially, particularly, not exceeding about 10000 psi. The protector 200 is also designed to have a smaller running profile than traditional latch type protectors as shown in the dashed line 268. To increase the holding force, an interior surface 270 of each clamping member 222*a–b* can include gripping nipples 272 distribute randomly or in a given pattern on the interior surface 270, with patterns being preferred.

Referring now to FIG. 2I–L, one preferred embodiment of a protector of this invention, generally 200, is shown attached across a joint 202 connecting two pipes 204 of a pipe string 206 within a cased well 208 including a casing 210 and a casing sleeve 212. The protector 200 includes a pair of C-shaped clamping members 222*a–b*, a corresponding pair of bridging members 224*a–b* and an elongate tubing protective member 226 connected to and extending between the two C-shaped clamping member-bridging member pairs 222*a*+224*a* and 222*b*+224*b*.

Each C-shaped member 222*a–b* includes a taper latch key connector 228 at a first end 230, a hinge connector 232 at a second end 234 and stress relieving longitudinally extending indentations 235, one indentation 235 located near the key connector 228 and the other indentation 235 located near the hinge connector 232. The C-shaped members 222*a–b* also include beveled shoulders 229 located on each side of the indentations 235, where the beveled shoulders 229 are designed to minimize protector hangup during downhole operations. Each C-shaped clamping member 222*a–b* is designed to be forced onto the pipes 204, one below and one above the joint 202. The C-shaped clamping members 222*a–b* have an arcuate shape and are designed to tightly engage the surface of the pipes 204 with sufficient holding force so that the remainder of the protector 200 can be assembled without requiring a person to hold the ends of the protector in place while the remainder of the protector is assembled.

Each bridging member 224*a–b* includes a taper latch key connector 236 at a first end 238 and a hinge connector 240 at a second end 242. Each bridging member 224*a–b* also includes a beveled leading and trailing ends 244. The elongate member 226 includes first and second ends 246*a–b*, each end 246*a–b* includes right and left lateral hinge connectors 248*a–b* and an interior channel 250 including a first area 252 for receiving up to three small bare tubes 254 and a second larger area 256 for receiving a square insulated tube 258 and up to two larger bare tubes 259.

The tapered latch key connectors 228 on the C-shaped members 222*a–b* and the tapered latch key connectors 236 are designed to engaged each other and to receive tapered keys 260. The key 260 includes a beveled top 262. The hinge connectors 232 on the C-shaped members 222*a–b* and the left hinge connectors 248*b* on the elongate member 226 are designed to engage each other and to receive hinge pins 264. While the right hinge connectors 248*a* on the elongate member 226 and the hinge connectors 240 on the bridging members 224*a–b* are designed to engage each other and to receive hinges pin 266.

The protector 200 is designed to be assembled by first forcing the clamping member 222*a–b* over the pipes 204 above and below the joint 202, where the member 222*a–b* hold the pipe with sufficient holding force to allow one person to install the protector 200 without concern of the clamping members 222*a–b* sliding down the pipes 204. Next, the hinge connectors 248*a–b* on the protecting member 226, the hinge connectors 232 on the clamping member 222*a–b* and the hinge connectors 240 on the bridging members 224*a–b* are mated and the hinge pins 264 and 266 are inserted into the mated connectors to form hinge connections. Finally, the latch connectors 228 and 236 are mated and the latch keys 260 are inserted. Once fully made up, the protectors 200 are designed to engage the pipes 204 with sufficient holding force to resist movement upon application of an external force not exceeding about 3000 psi, preferably, not exceeding about 4000 psi, particularly, not exceeding about 6000 psi, more particularly, not exceeding about 8000 psi, most particularly, not exceeding about 9000 psi and especially, particularly, not exceeding about 10000 psi. The protector 200 is also designed to have a smaller running profile than traditional latch type protectors as shown in the dashed line 268. To increase the holding force, an interior surface 270 of each clamping member 222*a–b* can include circumferentially extending protrusions 272 distribute randomly or in a given pattern on the interior surface 270, with patterns being preferred.

Referring now to FIG. 2M–P, one preferred embodiment of a protector of this invention, generally 200, is shown attached across a joint 202 connecting two pipes 204 of a pipe string 206 within a cased well 208 including a casing 210 and a casing sleeve 212. The protector 200 includes a pair of C-shaped clamping members 222*a–b*, a corresponding pair of bridging members 224*a–b* and an elongate tubing protective member 226 connected to and extending between the two C-shaped clamping member-bridging member pairs 222*a*+224*a* and 222*b*+224*b*.

Each C-shaped member 222*a–b* includes a taper latch key connector 228 at a first end 230, a hinge connector 232 at a second end 234 and stress relieving longitudinally extending indentations 235, one indentation 235 located near the key connector 228 and the other indentation 235 located near the hinge connector 232. The C-shaped members 222*a–b* also include beveled shoulders 229 located on each side of the indentations 235, where the beveled shoulders 229 are designed to minimize protector hangup during downhole operations. Each C-shaped clamping member 222*a–b* is designed to be forced onto the pipes 204, one below and one above the joint 202. The C-shaped clamping members 222*a–b* have an arcuate shape and are designed to tightly engage the surface of the pipes 204 with sufficient holding force so that the remainder of the protector 200 can be assembled without requiring a person to hold the ends of the protector in place while the remainder of the protector is assembled.

Each bridging member 224*a–b* includes a taper latch key connector 236 at a first end 238 and a hinge connector 240 at a second end 242. Each bridging member 224*a–b* also includes a beveled leading and trailing ends 244. The elongate member 226 includes first and second ends 246*a–b*, each end 246*a–b* includes right and left lateral hinge connectors 248*a–b* and an interior channel 250 including a single area 252 for receiving an insulated tube bare tubes 254 and up to two large bare tubes 258.

The tapered latch key connectors 228 on the C-shaped members 222*a–b* and the tapered latch key connectors 236 are designed to engaged each other and to receive tapered keys 260. The key 260 includes a beveled top 262. The hinge connectors 232 on the C-shaped members 222*a–b* and the left hinge connectors 248*b* on the elongate member 226 are designed to engage each other and to receive hinge pins 264. While the right hinge connectors 248*a* on the elongate member 226 and the hinge connectors 240 on the bridging members 224*a–b* are designed to engage each other and to receive hinges pin 266.

The protector 200 is designed to be assembled by first forcing the clamping member 222*a–b* over the pipes 204 above and below the joint 202, where the member 222*a–b* hold the pipe with sufficient holding force to allow one person to install the protector 200 without concern of the clamping members 222*a–b* sliding down the pipes 204. Next, the hinge connectors 248*a–b* on the protecting member 226, the hinge connectors 232 on the clamping member 222*a–b* and the hinge connectors 240 on the bridging members 224*a–b* are mated and the hinge pins 264 and 266 are inserted into the mated connectors to form hinge connections. Finally, the latch connectors 228 and 236 are mated and the latch keys 260 are inserted. Once fully made up, the protectors 200 are designed to engage the pipes 204 with sufficient holding force to resist movement upon application of an external force not exceeding about 3000 psi, preferably, not exceeding about 4000 psi, particularly, not exceeding about 6000 psi, more particularly, not exceeding about 8000 psi, most particularly, not exceeding about 9000 psi and especially, particularly, not exceeding about 10000 psi. The protector 200 is also designed to have a smaller running profile than traditional latch type protectors as shown in the dashed line 268. To increase the holding force, an interior surface 270 of each clamping member 222*a–b* can include teeth 272 distribute randomly or in a given pattern on the interior surface 270, with patterns being preferred.

The beveling on the clamping members and on the bridging members and on the key are designed to allow the production string with the protectors of this invention to be run down wells with significant deviations, while minimizing the likelihood that the string will get hung up due to the protector chancing on an interior ridge of the casing or casing sleeve.

Figure 3A:
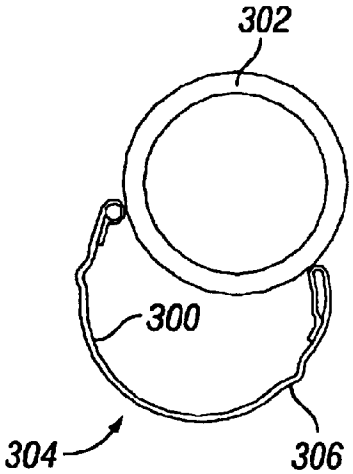
FIGS. 3A–B depict cross-sectional views of a C-shaped members and a pipe before being forced onto the pipe and after.
Figure 3B:
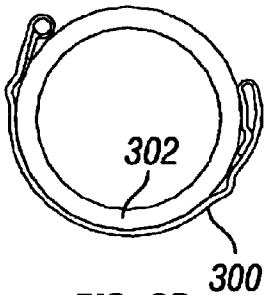

Referring now to FIGS. 3A&B, a clamping member 300 is set adjacent a pipe 302 at a position above a joint (not shown). A rubber mallet is hit firmly against a position 304 on an exterior surface 306 of the member 300 forcing the clamping member 300 onto the pipe 302 as shown in FIG. 3B. Once forced onto the pipe 302, the clamping member 300 holds its position and can only be moved by the application of sufficient force to slide it along the pipe of proper positioning. This force is not so high that the installer cannot move the clamping member, but is sufficient to hold the clamping members in place as the bridging members and elongated member are attached by hinge pins and latch keys. When the latch key is inserted into the tapered latch key connection, it draws the protector at the clamping member up against the pipe with sufficient holding force to resist an external force not to exceed about 3000 psi, preferably, not exceeding about 4000 psi, particularly, not exceeding about 6000 psi, more particularly, not exceeding about 8000 psi, most particularly, not exceeding about 9000 psi and especially, particularly, not exceeding about 10000 psi as stated above.

Figure 4A:
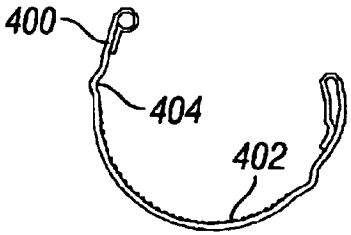
FIGS. 4A–F depict three preferred embodiments of C-clamping members of this invention with raised elements on an interior surface of the member.
Figure 4B:
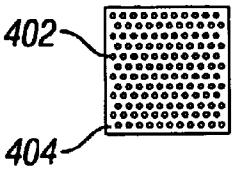
Figure 4C:
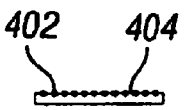

Referring now to FIGS. 4A&C, the clamping member 400 is shown to include raised elements 402 protruding from an interior surface 404 of the member 400. The raised elements 402 can be of any design raised protrusions such as domes, spikes, squares, or the like. Looking at FIG. 4B, the raised elements 402 are shown as domes, while in FIG. 4B, the raised elements 402 are shown as spikes or triangular protrusions. These elements 402 are designed to increase the holding force between the interior surface 404 and a pipe (not shown).

Figure 4D:
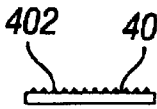
Figure 4E:
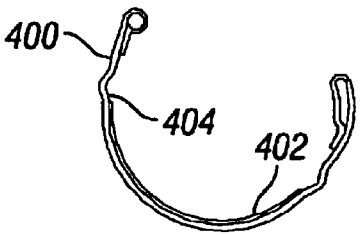
Figure 4F:
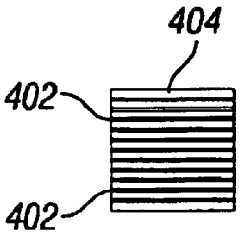

Referring now to FIGS. 4D&E, the clamping member 400 is shown to include raised elements 402 protruding from an interior surface 404 of the member 400. The raised elements 402 can be any designed raised protrusions such as domes, spikes, squares, or the like. Looking at FIG. 5B, the raised elements 402 are shown as domes, while in FIG. 5B, the raised elements 402 are shown as spikes or triangular protrusions. These elements 402 are designed to increase the holding force between the interior surface 404 and a pipe (not shown).

All references cited herein are incorporated by reference. While this invention has been described fully and completely, it should be understood that, within the scope of the appended claims, the invention may be practiced otherwise than as specifically described including changes and modification that may be made which do not depart from the scope and spirit of the invention as described above and claimed hereafter.

I claim:

1. A protector apparatus for protecting joints and production tubing associated with a drill or production string comprising:

an elongate tubing protective member having first and second ends, each end including right and left hinge connectors;

a pair of bridging members having first and second ends, one end including a hinge connector and the other end including a latching connector;

a pair of C-shaped clamping member having first and second ends, one end including a hinge connector and the other end including a latching connector;

a pair of hinge pins adapted to insert into mated pairs of hinge connectors to form hinge connections; and a pair of latch keys adapted to insert into mated pairs of latch connectors to form latch connections, where the C-shaped clamping members are designed to be forced over a pipe one above a joint, one below the joint, and having a sufficient clamping force to hold in the clamping member is place during apparatus assembly.

2. The apparatus of claim 1, wherein after key insertion in the latch key connection, the apparatus has a sufficient holding force to resist an external force does not exceed about 4000 psi.

3. The apparatus of claim 1, wherein after key insertion in the latch key connection, the apparatus has a sufficient holding force to resist an external force does not exceed about 6000 psi.

4. The apparatus of claim 1, wherein after key insertion in the latch key connection, the apparatus has a sufficient holding force to resist an external force does not exceed about 8000 psi.

5. The apparatus of claim 1, wherein after key insertion in the latch key connection, the apparatus has a sufficient holding force to resist an external force does not exceed about 9000 psi.

6. The apparatus of claim 1, wherein after key insertion in the latch key connection, the apparatus has a sufficient holding force to resist an external force does not exceed about 10000 psi.

7. The apparatus of claim 1, further comprising longitudinally extending stress relieving protrusion or indentations.

8. The apparatus of claim 1, further comprising longitudinally extending stress relieving indentations.

9. The apparatus of claim 1, wherein the bridging members include beveled top and bottom ends and the clamping members include beveled shoulders, where the beveled ends and shoulders are designed to reduce hangup of the apparatus during downhole operations.

10. The apparatus of claim 1, wherein the elongate member further includes an interior channel for receiving production tubing.

11. The apparatus of claim 1, wherein after key insertion in the latch key connection, the apparatus has a sufficient holding force to resist an external force not to exceed about 3000 psi.

12. A protector apparatus for protecting joints and production tubing associated with a drill or production string comprising:

an elongate tubing protective member including first and second ends, each end having right and left hinge connectors;

a pair of bridging members including first and second beveled ends, one end having a hinge connector and the other end having a latching connector;

a pair of C-shaped clamping member having first and second ends and two stress relieving members located near each end, one end including a hinge connector and the other end including a latching connector;

a pair of hinge pins adapted to insert into mated pairs of hinge connectors to form hinge connections; and a pair of latch keys adapted to insert into mated pairs of latch connectors to form latch connections, where the C-shaped clamping members are designed to be forced over a pipe one above a joint, one below the joint, and having a sufficient clamping force to hold in the clamping member is place during apparatus assembly, and where the first and second beveled ends are designed to reduce hangup during downhole operations and where, after key insertion in the latch key connection, the apparatus has a sufficient holding force to resist an external force not to exceed about 3000 psi.

13. The apparatus of claim 12, wherein the external force does not exceed about 4000 psi.

14. The apparatus of claim 12, wherein the external force does not exceed about 6000 psi.

15. The apparatus of claim 12, wherein the external force does not exceed about 8000 psi.

16. The apparatus of claim 12, wherein the external force does not exceed about 9000 psi.

17. The apparatus of claim 12, wherein the external force does not exceed about 10000 psi.

18. The apparatus of claim 12, wherein extending stress relieving member are indentations.

19. The apparatus of claim 12, wherein the elongate member further includes an interior channel for receiving control tubing or cable.

20. A method for mounting a joint protector comprising the steps of:

positioning a first C-shape clamping member above a joint of a drill string, forcing the first C-shape clamping member onto a first section of the drill string above the joint, where the first member engages the first section with sufficient clamping force to remain in place during protector mounting, positioning a second C-shape clamping member below a joint of the drill string, forcing the member onto a second section of the drill string below the joint, where the second member engages the the second section with sufficient clamping force to remain in place during protector mounting, fitting control tubing or cable in an interior groove of an elongate tubing protecting member;

mating hinge connectors of the elongate tubing protector with corresponding hinge connectors on the C-shaped clamping members to form first hinge connections, inserting hinge pins into the first hinge connections, mating hinge connectors of bridging members with corresponding hinge connectors on the elongate tubing protecting member to form second hinge connections, inserting hinge pins into the second hinge connections, mating latch connectors on the bridging members to latch connectors on the C-shaped clamping members to form latch connections, and inserting latch keys into the latch connectors to form a fully assembled protector over the joint, where the fully assembled protector has a holding force sufficient to resist an external force not exceeding about 3000 psi.

21. The method of claim 20, wherein the external force does not exceed about 4000 psi.

22. The method of claim 20, wherein the external force does not exceed about 6000 psi.

23. The method of claim 20, wherein the external force does not exceed about 8000 psi.

24. The method of claim 20, wherein the external force does not exceed about 9000 psi.

25. The method of claim 20, wherein the external force does not exceed about 10000 psi.

26. The method of claim 20, wherein the protector further comprising longitudinally extending stress relieving protrusion or indentations.

27. The method of claim 20, wherein the bridging members include beveled top and bottom ends and the clamping members include beveled shoulders, where the beveled ends and shoulders are designed to reduce hangup of the apparatus during downhole operations.

28. A protector apparatus for protecting joints and production tubing associated with a drill or production string comprising:

an elongate tubing protective member having first and second ends, each end including right and left hinge connectors;

a pair of bridging members having first and second ends, one end including a hinge connector and the other end including a latching connector;

a pair of clamping member having first and second ends, one end including a hinge connector and the other end including a latching connector;

a pair of hinge pins adapted to insert into mated pairs of hinge connectors to form hinge connections; and a pair of latch keys adapted to insert into mated pairs of latch connectors to form latch connections, where the clamping members are designed to be forced over a pipe one above a joint, one below the joint, and having a sufficient clamping force to hold in the clamping member is place during apparatus assembly.

29. The apparatus of claim 28, wherein after key insertion in the latch key connection, the apparatus has a sufficient holding force to resist an external force not to exceed about 3000 psi.

30. The apparatus of claim 28, wherein after key insertion in the latch key connection, the apparatus has a sufficient holding force to resist an external force does not exceed about 4000 psi.

31. The apparatus of claim 28, wherein after key insertion in the latch key connection, the apparatus has a sufficient holding force to resist an external force does not exceed about 6000 psi.

32. The apparatus of claim 28, wherein after key insertion in the latch key connection, the apparatus has a sufficient holding force to resist an external force does not exceed about 8000 psi.

33. The apparatus of claim 28, wherein after key insertion in the latch key connection, the apparatus has a sufficient holding force to resist an external force does not exceed about 9000 psi.

34. The apparatus of claim 28, wherein after key insertion in the latch key connection, the apparatus has a sufficient holding force to resist an external force does not exceed about 10000 psi.

35. The apparatus of claim 28, further comprising longitudinally extending stress relieving protrusion or indentations.

36. The apparatus of claim 28, further comprising longitudinally extending stress relieving indentations.

37. The apparatus of claim 28, wherein the bridging members include beveled top and bottom ends and the clamping members include beveled shoulders, where the beveled ends and shoulders are designed to reduce hangup of the apparatus during downhole operations.

38. The apparatus of claim 28, wherein the elongate member further includes an interior channel for receiving production tubing.

* * * * *